US006551022B1

(12) United States Patent
Stayner

(10) Patent No.: US 6,551,022 B1
(45) Date of Patent: Apr. 22, 2003

(54) COMPACTOR MACHINE HAVING VIBRATION DAMPING MEANS

(75) Inventor: Richard Stayner, Ludlow (GB)

(73) Assignee: Benford Limited (GB)

( * ) Notice: Subject to any disclaimer, the term of this patent is extended or adjusted under 35 U.S.C. 154(b) by 37 days.

(21) Appl. No.: 09/711,162

(22) Filed: Nov. 9, 2000

(30) Foreign Application Priority Data

Nov. 13, 1999 (GB) ..... 9926821

(51) Int. Cl.[7] ..... E01C 19/30
(52) U.S. Cl. ..... 404/133.1; 404/133.05
(58) Field of Search ..... 404/133.05, 133.1, 404/113

(56) References Cited

U.S. PATENT DOCUMENTS

| | | | | |
|---|---|---|---|---|
| 3,782,845 A | * | 1/1974 | Briggs et al. | 404/133.1 |
| 4,043,694 A | | 8/1977 | Mullen | 404/133 |
| 4,067,244 A | | 1/1978 | Baumers | 74/61 |
| 5,645,370 A | | 7/1997 | Zürbes et al. | 404/133 |
| 5,934,825 A | * | 8/1999 | Waldenberger | 404/133.1 |

FOREIGN PATENT DOCUMENTS

| | | |
|---|---|---|
| GB | 1396373 | 6/1975 |
| GB | 2016563 | 9/1979 |
| GB | 1578696 | 11/1980 |
| GB | 2115466 A | 9/1983 |
| GB | 2315796 | 2/1998 |

* cited by examiner

*Primary Examiner*—Heather Shackelford
*Assistant Examiner*—Sunil Singh
(74) *Attorney, Agent, or Firm*—MacMillan, Sobanski & Todd, LLC

(57) ABSTRACT

A compactor machine of the kind controlled by a pedestrian operator. The machine includes a base plate, an operative unit mounted on the base plate, a support plate, and a main frame. The operative unit causes the base plate to vibrate during use of the machine. The machine also includes a handle by which the operator controls the machine during use. A plurality of damping mounts attach a secondary frame to the main frame at a point distant from the base plate and the handle is mounted on the secondary frame to reduce the transmission of vibrations to an operator holding the handle.

10 Claims, 5 Drawing Sheets

COMPACTOR MACHINE HAVING VIBRATION DAMPING MEANS

BACKGROUND TO THE INVENTION

The invention relates to a compactor machine and in particular to one of the kind operated by a pedestrian for fairly light compacting of the ground.

Compactor machines of this kind are generally known as forward vibrating plate compactors, and many slightly different forms are known. In general they comprise an engine which transmits power via a pulley belt to an eccentric mass unit attached to a base plate. The mass is rotated generating a centrifugal force, and simultaneously applying a downward force with motion in a forward direction. The machine is guided by a pedestrian operator via a steering handle.

A major problem with many of the prior art compactors of this type is the level of vibration transmitted to the hands of the operator, and generally known as Hand-Arm Vibration (H.A.V.). Various approaches to the problem have been tried without much success, as significant vibration is still transmitted. This can lead to a medical condition, commonly known as Vibration White Finger, in operators who use these machines for extended periods of time, and which is clearly undesirable. The European Union has issued guidelines for safe levels of H.A.V., which can be experienced over an eight hour duration, of 2.5 $ms^{-2}$. If manufacturers produce machines with levels of H.A.V. higher than this level they are required to state this in their product literature.

Clearly, if the level of H.A.V. can be reduced the operators' health and comfort are considerably enhanced, and longer working periods can also be contemplated.

It is an object of the present invention to mitigate the above described problem.

SUMMARY OF THE INVENTION

According to the present invention there is provided compactor machine of the kind controlled by a pedestrian operator and including a base plate, an operative unit, mounted on the base plate, and having a support plate and a main frame, and means to cause the base plate to vibrate when in use, and a handle by which the operator controls the machine in use, wherein the compactor machine further comprises a secondary frame mounted on the main frame by means of a plurality of first damping mounts and wherein the handle is mounted on the secondary frame.

Preferably the secondary frame is mounted on the main frame distant from the base plate.

The handle may be pivotally mounted on the secondary frame.

Preferably the plurality of first damping mounts comprises four arranged substantially in a rectangle in a plane substantially parallel to the base plate. Each first damping mount may be inclined upwardly and outwardly.

The main frame may substantially define the outer dimensions of the operative unit.

The plurality of first damping mounts may have a stiffness in the range 10 to 20 $Nmm^{-1}$, or it may be in the range 12.5 to 17.5 $Nmm^{-1}$.

Preferably the operative unit is mounted on the base plate by means of a plurality of second damping mounts.

The plurality of second damping mounts generally comprises four arranged substantially in a rectangle.

Conveniently the plurality of second damping mounts have a stiffness in the range 30 to 70 $Nmm^{-1}$, or it may be in the range 40 to 60 $Nmm^{-1}$.

BRIEF DESCRIPTION OF THE DRAWINGS

An embodiment of a compactor machine according to the invention will now be described, by way of example only, with reference to the accompanying drawings in which.

DESCRIPTION OF THE PREFERRED EMBODIMENTS

Figure 1:
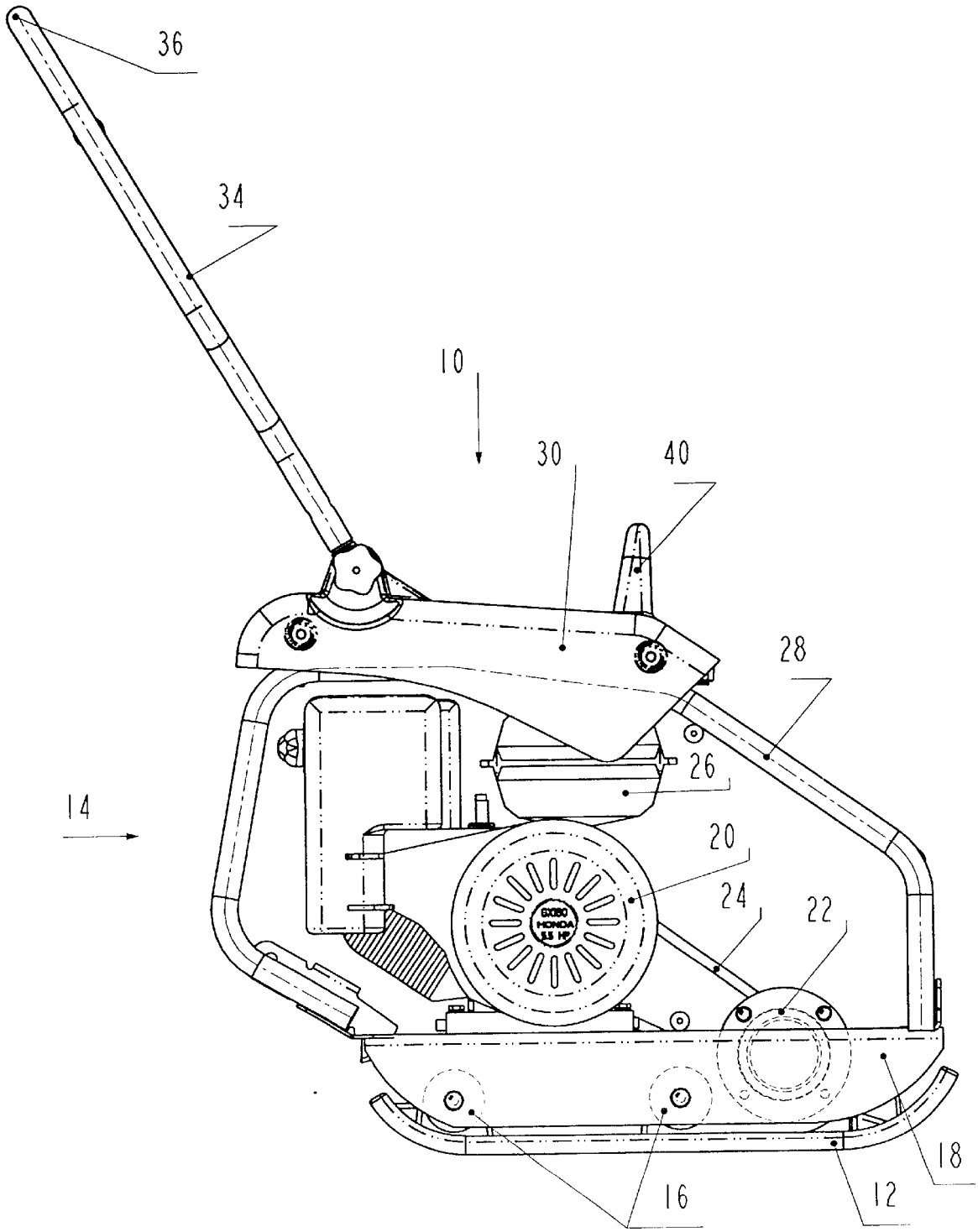
FIG. 1 is a simplified side view of the compactor machine according to the invention.
Figure 2:
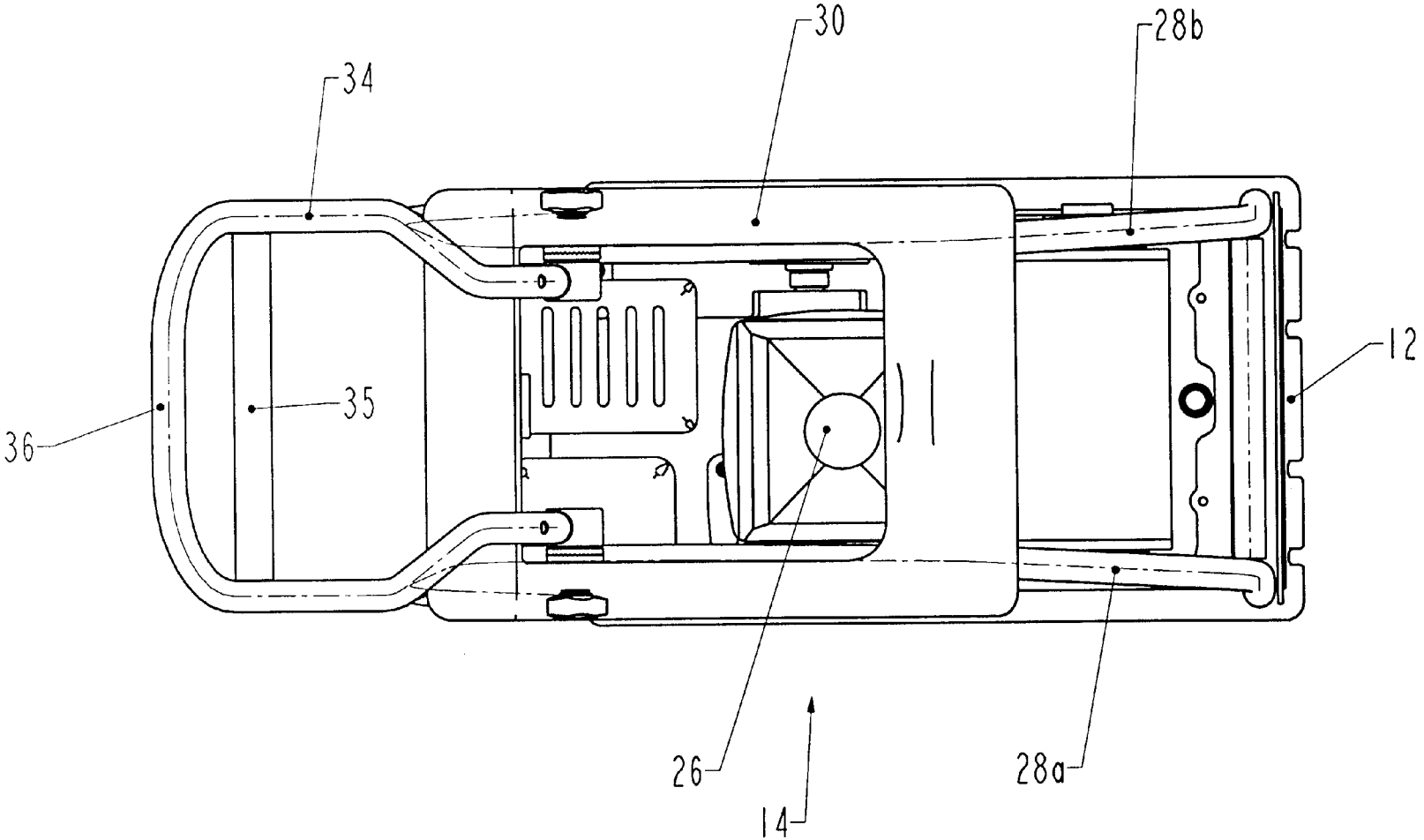
FIG. 2 is a simplified plan view of the compactor machine of FIG. 1.
Figure 3:
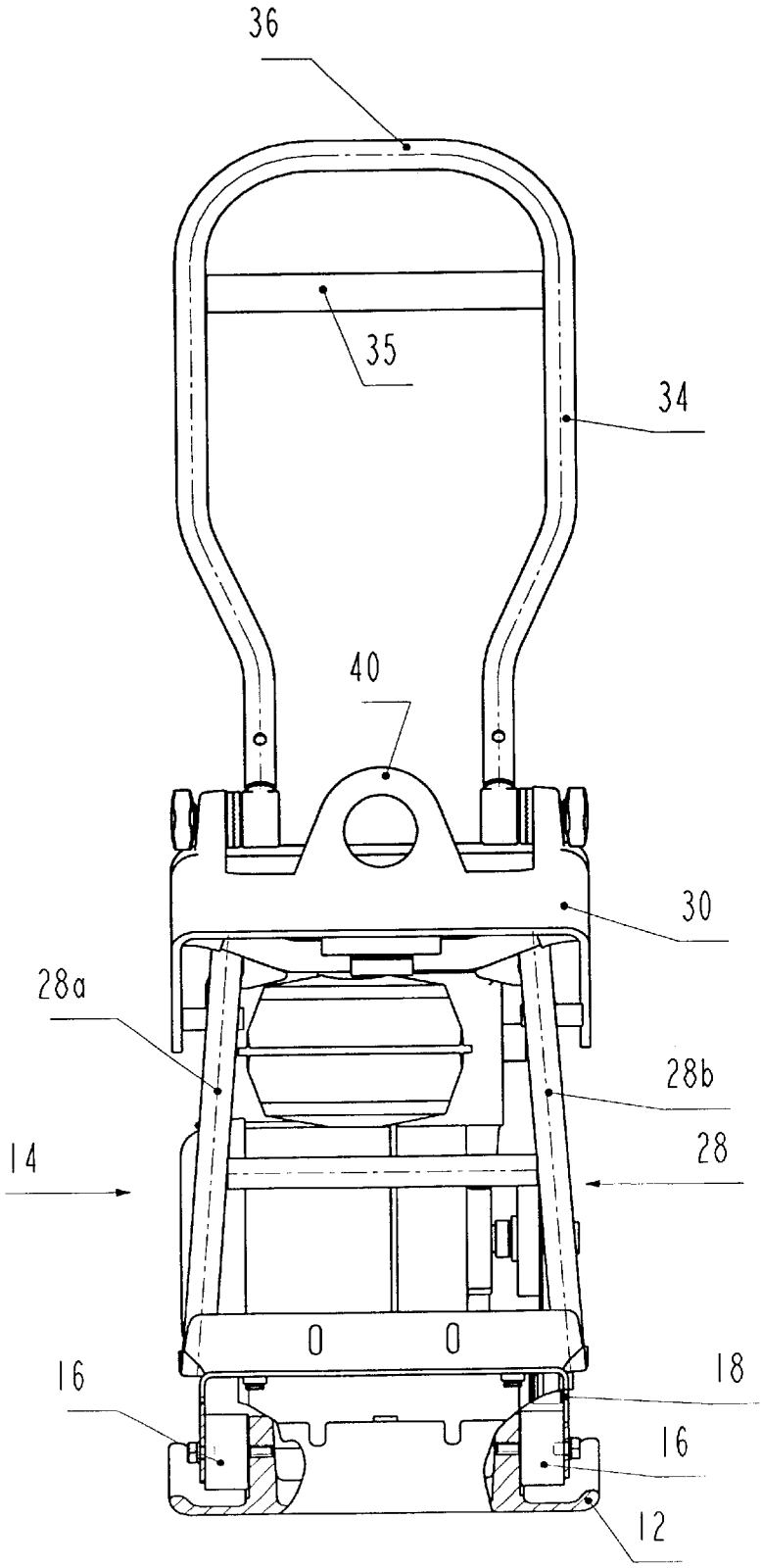
FIG. 3 is a simplified front view of the compactor machine of FIGS. 1 and 2.
Figure 4:
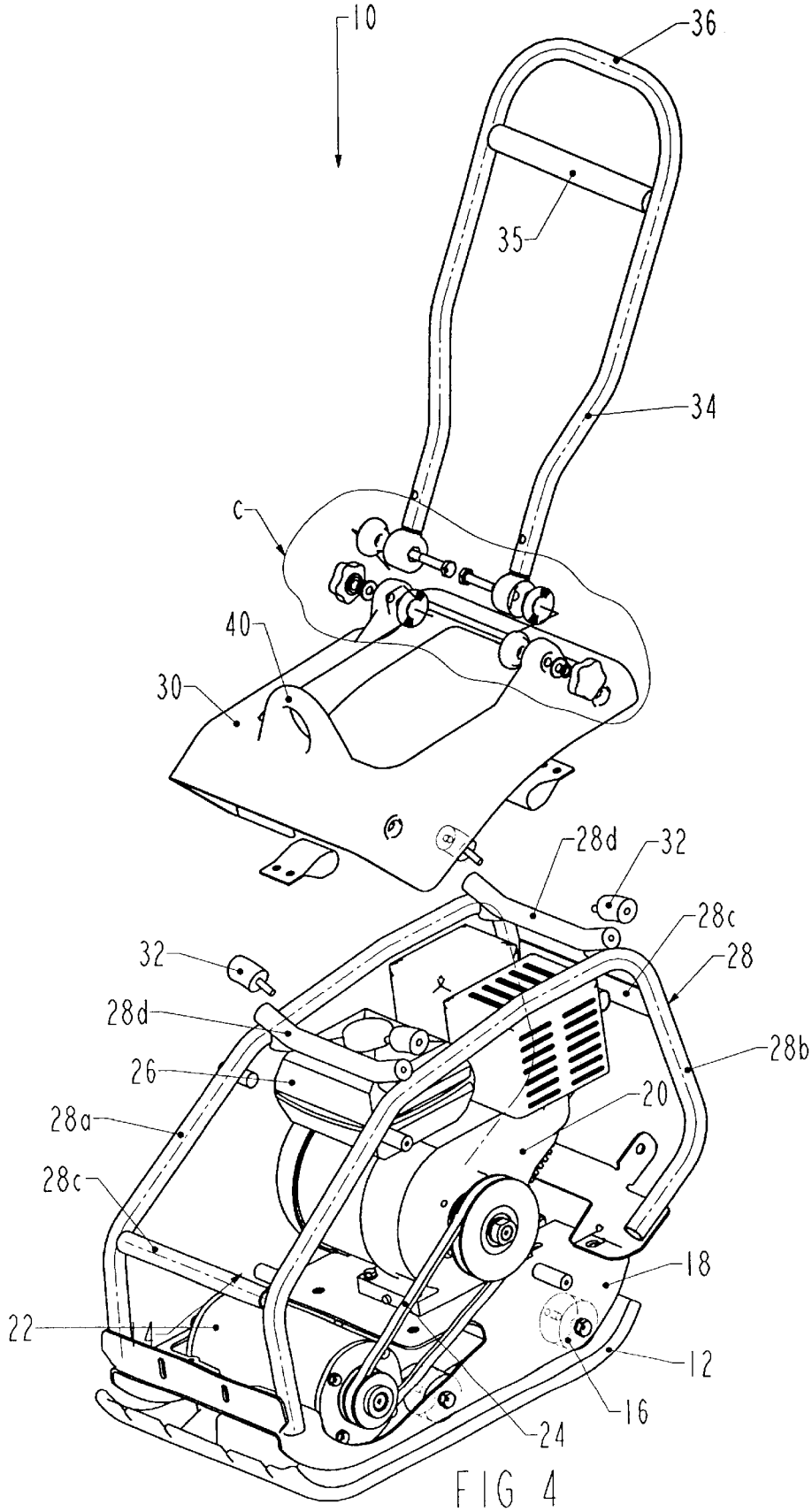
FIG. 4 is a partially exploded perspective view of the compactor machine of FIGS. 1 and 2.

Referring now to the Figures, a compactor machine 10 is of the kind generally known as a forward vibrating plate compactor. It includes a base plate 12 on which is supported an operative unit 14 by means of primary damping mounts 16. There are four primary damping mounts 16 arranged in a rectangle, two on each side of the machine 10 with their outer edges separated by 295 mm. The pairs on each side of the machine 10 are themselves separated forwardly and rearwardly, with their centers 220 mm apart. The primary damping mounts 16 take the form of relatively stiff rubber having a stiffness in the range 30 to 70 $Nmm^{-1}$, with the value of 50 $Nmm^{-1}$ being preferred in many instances.

The operative unit 14 includes a support plate 18, with mounted thereon conventional means to cause the base plate 12 to vibrate in use. Such means comprise an engine 20, an eccentric mass 22 mounted on the base plate 12 and driveable by the engine 20 by means of a drive belt 24. A fuel tank 26 supplies fuel for the engine 20.

The frequency of operation of the machine 10 is 98 Hz, but could generally be any where in the range 90–105 Hz. The machine 10 has a weight of 75 kg, but that generally could lie in the range 65–85 kg. Clearly machines of this kind could also be manufactured with operating frequencies or weights outside these ranges.

The operative unit 14 also includes a main frame 28 which has two tubular parts 28*a* and 28*b* one on each side of the machine 10, and which are each substantially "C" shaped, with one end secured to the support plate 18 at the rear and the other end secured to the support plate 18 at the front. The main frame 28 also has cross braces between the two parts 28*a* and 28*b*, two straight cross-braces 28*c* and two with upturned ends 28*d* at the top. Thus in this embodiment the support plate 18 and main frame 28 between them substantially define the outer dimensions of the operative unit 14.

The compactor machine 10 further comprises a secondary frame 30 which is substantially rectangular in shape and which is mounted upon the main frame 28 by means of damping mounts 32. The secondary frame 30 is cast from aluminum alloy, but may be formed of other materials and by other techniques, e.g. from lengths of steel tube bent and welded.

In this embodiment there are four damping mounts 32 arranged in a rectangle, two on each side of the machine 10 with their outer edges separated by 340 mm. Each pair is separated forwardly and rearwardly, with their centers 340 mm apart. The forward damping mounts 32 are located 95.5 mm in front of the center of the engine 20.

The damping mounts 32 are not arranged horizontally, but rather are located on the ends of cross-members 28*d* of the main frame 28 which are upturned at their outer edges. Thus the damping means 32 are inclined upwardly and outwardly at an angle of approximately 20 degrees to the horizontal.

The damping mounts 32 take the form of relatively softer rubber having a stiffness in the range 10 to 20 $Nmm^{-1}$, with the value of 15 $Nmm^{-1}$ being preferred in many instances.

A steering handle 34, with a grip portion 36, is pivotally secured to the secondary frame 30, such that it may be used at a comfortable angle of choice by an operator, and folded flat towards the machine 10 for storage. The handle 34 is pivoted 70 mm in front of the rearward damping mounts 32.

The handle 34 is conveniently formed from bent steel tube and has a cross-member 35 towards its upper end. The cross-member 35 has been formed to reduce transmission of vibrations up the handle 34 best when formed of solid bar, rather than tube with a weight in excess of 1 kg.

Figure 5:
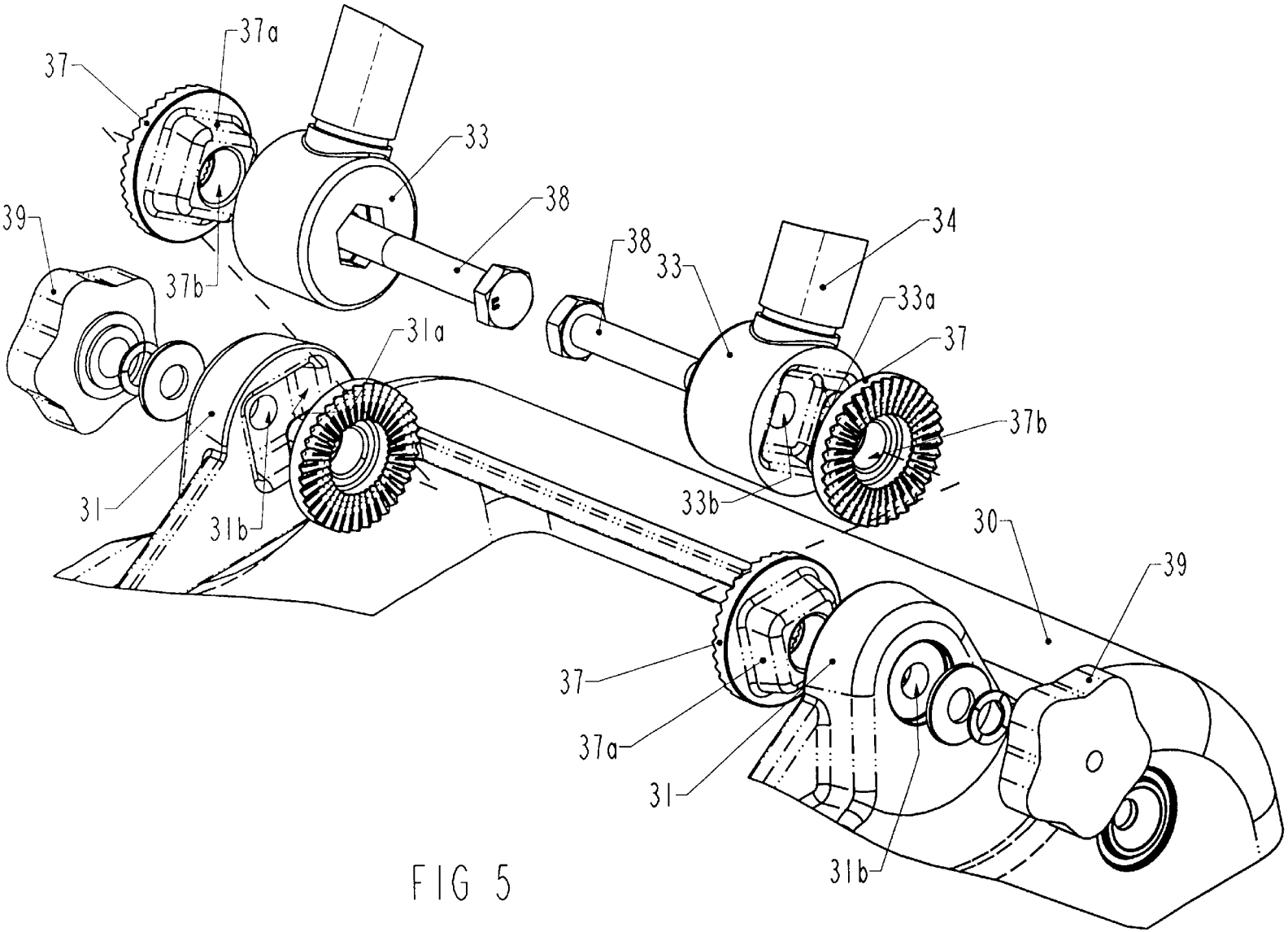
FIG. 5 is an enlarged exploded view of the area referenced C on FIG. 4.

The handle 34 is lockable at any desired position relative to the operative unit 14, as this has been found to further reduce the transmission of vibrations to the grip portion 36 when compared with "floating" handles. The locking arrangement is shown in FIG. 5. Two lugs 31 extend upwardly from the top of the secondary frame 30, each of which has an inwardly facing square recess 31*a*, and an opening 31*b* in the center thereof. The handle 34 has at each end a boss 33 with an outwardly facing square recess 33*a*, and an opening 33*b* in the center thereof. Four serrated inserts 37 have square protuberances 37*a* on their rear faces and central openings 37*b*. An insert 37 is received in each of the square recesses 31*a* and 33*a* such that pairs of inserts 37 are facing each other and the serrations can inter-engage.

To hold the components together bolts 38 are passed through the aligned openings 31*b*, 37*b*, 33*b* and nuts 39, adapted for use by hand, are screwed onto their threads, various washers being used as desired.

To secure the handle 34 at the desired angle to the operative unit 14 the operator simply loosens off the two nuts 39 such that the serrations on the inserts 37 are no longer forced into engagement with each other, pivots the handle 34 to the desired angle and re-tightens the nuts 39.

This arrangement for the locking and pivoting of the handle 34 has a number of advantages. One of these is that the serrated inserts 37, which are the parts that will wear in use, are readily replaceable without the use of tools.

Also secured to the secondary frame 30, towards the front, i.e. distant from the steering handle 34, is a lifting handle 40 to assist in lifting the machine 10 when required.

The embodiment described above provides the advantage that the damping mounts 32 and the general arrangement of the main and secondary frames 28, 30 significantly reduces the vibrations passed from the operative unit 14 to the steering handle 34, and thus reduces the vibration transmitted to the operator's hands.

Variations to the above described embodiment may be made whilst remaining within the scope of the invention. For example there may be more or fewer damping mounts 16 and/or 32, and they may be arranged in other ways. Further, the damping mounts 32 and 16 themselves need not be made of rubber but may be formed of any appropriate material. The various dimensions given above may also be varied as appropriate for other weights of machine and individual components such as the engine 20. Likewise the weight and frequency of operation may vary outside the ranges described if appropriate.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A compactor machine of the kind controlled by a pedestrian operator and including a base plate, an operative unit, mounted on the base plate and having a support plate and a main frame and means to cause the base plate to vibrate when in use, and a handle by which the operator controls the machine in use, wherein the compactor machine further comprises a secondary frame mounted on the main frame by means of a plurality of first damping mounts and wherein the handle is mounted on the secondary frame, wherein the handle is pivotally mounted on the secondary frame, and wherein the handle is lockable in a plurality of selected positions.

2. A compactor machine according to claim 1 wherein the plurality of first damping mounts comprises four arranged substantially in a rectangle in a plane substantially parallel to the base plate.

3. A compactor machine according to claim 1 wherein each of the plurality of the first damping mounts is inclined upwardly and outwardly.

4. A compactor machine according to claim 1 wherein the plurality of first damping mounts have a stiffness in the range 10 to 20 $Nmm^{-1}$.

5. A compactor machine according to claim 1 wherein the plurality of first damping mounts have a stiffness in the range 12.5 to 17.5 $Nmm^{-1}$.

6. A compactor machine according to claim 1 wherein the main frame substantially defines the outer dimensions of the operative unit.

7. A compactor machine according to claim 1 wherein the operative unit is mounted on the base plate by means of a plurality of second damping mounts.

8. A compactor machine according to claim 7 wherein the plurality of second damping mounts comprises four arranged substantially in a rectangle.

9. A compactor machine according to claim 7 wherein the plurality of second damping mounts have a stiffness in the range 30 to 70 $Nmm^{-1}$.

10. A compactor machine according to any one of claim 7 wherein the plurality of second damping mounts have a stiffness in the range 40 to 60 $Nmm^{-1}$.

* * * * *